US006975276B2

(12) United States Patent
Brown

(10) Patent No.: US 6,975,276 B2
(45) Date of Patent: Dec. 13, 2005

(54) SYSTEM AND LOW-LOSS MILLIMETER-WAVE CAVITY-BACKED ANTENNAS WITH DIELECTRIC AND AIR CAVITIES

(75) Inventor: Kenneth W. Brown, Yucaipa, CA (US)

(73) Assignee: Raytheon Company, Waltham, MA (US)

( * ) Notice: Subject to any disclaimer, the term of this patent is extended or adjusted under 35 U.S.C. 154(b) by 0 days.

(21) Appl. No.: 10/796,927

(22) Filed: Mar. 10, 2004

(65) Prior Publication Data

US 2004/0174314 A1 Sep. 9, 2004

Related U.S. Application Data

(63) Continuation-in-part of application No. 10/232,743, filed on Aug. 30, 2002, now abandoned.

(51) Int. Cl.[7] ..... H01Q 13/10; H01Q 1/42
(52) U.S. Cl. ..... 343/767; 343/795; 343/789
(58) Field of Search ..... 343/767, 795, 343/789, 700 MS, 770, 771, 705, 708; H01Q 13/10, H01Q 1/42

(56) References Cited

U.S. PATENT DOCUMENTS

| | | | | |
|---|---|---|---|---|
| 4,958,165 | A * | 9/1990 | Axford et al. | 343/770 |
| 5,724,049 | A * | 3/1998 | Park et al. | 343/705 |
| 6,198,445 | B1 * | 3/2001 | Alt et al. | 343/705 |
| 6,847,328 | B1 * | 1/2005 | Libonati et al. | 343/700 MS |

* cited by examiner

*Primary Examiner*—Hoanganh Le
(74) *Attorney, Agent, or Firm*—Thomas J. Finn; Lenoard Alkov; Karl A. Vick

(57) ABSTRACT

A cavity backed millimeter-wave antenna comprises a dielectric cavity within a semiconductor substrate having walls defined by a plurality of vias through the substrate, and a gas cavity external to the substrate aligned with the dielectric cavity. A ground plane side of the substrate may be devoid of ground plane conductive material substantially between the walls of the dielectric cavity. In a slot-antenna embodiment, a microstrip feed line may be disposed on the substrate across a slot over the cavities. The slot may be a rectangular region without conductive material on a circuit side of the substrate over the dielectric cavity. In a dipole embodiment, a first pole comprising conductive material may be disposed on a ground plane side of the substrate over the cavities, and a second pole comprising conductive material may be disposed on a circuit side of the substrate over the cavities.

42 Claims, 6 Drawing Sheets

SYSTEM AND LOW-LOSS MILLIMETER-WAVE CAVITY-BACKED ANTENNAS WITH DIELECTRIC AND AIR CAVITIES

This application is a Continuation in Part of Ser. No. 10/232,743 filed Aug. 30, 2002, now abandoned.

TECHNICAL FIELD

Embodiments of the present invention pertain to cavity-backed antennas systems.

BACKGROUND

Many current millimeter-wave antennas have efficiencies of fifty-percent or less. In the case of antennas used for high-power transmission, these low-efficiencies may result in a significant amount of input power being absorbed by the antenna structure and converted to heat. Furthermore, these low efficiencies require much higher input power levels.

Another problem with current millimeter-wave antennas is that manufacturing techniques make it difficult to precisely fabricate an antenna with particular performance characteristics and for a particular millimeter-wave frequency. This is especially a problem when the frequency and performance characteristics of the antenna need to be substantially identical or matched with other antennas, for example, when more than one antenna is combined with other antennas.

Thus, there are general needs for more efficient millimeter-wave antennas. There are also general needs for millimeter-wave antennas that can be precisely manufactured with predictable frequency and performance characteristics.

SUMMARY

A cavity backed millimeter-wave antenna comprises a dielectric cavity within a semiconductor substrate having walls defined by a plurality of vias through the substrate. The antenna also comprises a gas cavity external to the substrate aligned with the dielectric cavity. A conductive feed may be disposed on the substrate across the cavities. A ground plane side of the substrate may be devoid of ground plane conductive material substantially between the walls of the dielectric cavity. In a slot-antenna embodiment, the feed may be a microstrip feed line disposed on the substrate across a slot over the cavities. The slot may be a rectangular region without conductive material on a circuit side of the substrate over the dielectric cavity. In a dipole embodiment, a first pole comprising conductive material may be disposed on the ground plane side of the substrate over the cavities, and a second pole comprising conductive material may be disposed on a circuit side of the substrate over the cavities. The plurality of vias and one of the poles may be electrically coupled to ground, and the other of the poles may be coupled with the conductive feed.

The plurality of vias may precisely define the dielectric cavity as a rectangular dielectric cavity within the substrate having rectangular dimensions selected to resonate at a predetermined millimeter-wave frequency. The dimensions of the gas cavity may be greater than the dimensions of the dielectric cavity and selected to be non-resonant at the millimeter-wave frequency.

In some embodiments, a reflect-array antenna is provided. The reflect array antenna comprises a conductive plate, and a plurality of unit cells adhered to the conductive plate. In these embodiments, each unit cell may comprise a receive antenna to receive spatially-fed millimeter-wave signals of a first polarization, and a transmit antenna to re-transmit the received signals with a second polarization. In these embodiments, the receive antenna and the transmit antenna each may each comprise a dielectric cavity within a semiconductor substrate having walls defined by a plurality of vias through the substrate. The receive and transmit antennas may also each comprise a gas cavity within the conductive plate aligned with the dielectric cavity.

In some embodiments, a millimeter-wave transmission system is provided. The millimeter-wave transmission system may comprise a reflect-array antenna to provide a high-power substantially spherical coherent wavefront from a spatially-fed low power source, and a collimator to collimate the high-power wavefront and generate a substantially planar wavefront. The reflect-array antenna may comprise a plurality of unit cells adhered to the conductive plate. In some embodiments, each unit cell may include one or more power amplifiers to amplify received signals and provide amplified signals to transmit antenna for retransmission.

In some embodiments, a method of fabricating a reflect-array antenna is provided. In these embodiments, the method may include machining air cavities in a conductive plate, and providing unit cells each having a receive antenna and a transmit antenna thereon. The antennas may have dielectric cavities within the semiconductor substrate. The method may also include adhering the unit cells to the conductive plate to substantially align the air cavities with the dielectric cavities. In some embodiments, an epoxy well may be machined in the plate, and the well may be filled with an adhesive to adhere an amplifier portion of the substrate to the plate. In some alternate embodiments, the substrate may be adhered to the plate with indium solder.

BRIEF DESCRIPTION OF THE DRAWINGS

The appended claims are directed to some of the various embodiments of the present invention. However, the detailed description presents a more complete understanding of embodiments of the present invention when considered in connection with the figures, wherein like reference numbers refer to similar items throughout the figures and:

DETAILED DESCRIPTION

The following description and the drawings illustrate specific embodiments of the invention sufficiently to enable those skilled in the art to practice them. Other embodiments may incorporate structural, logical, electrical, process, and other changes. Examples merely typify possible variations. Individual components and functions are optional unless explicitly required, and the sequence of operations may vary. Portions and features of some embodiments may be included in or substituted for those of others. The scope of embodiments of the invention encompasses the full ambit of the claims and all available equivalents of those claims.

Figure 1A:
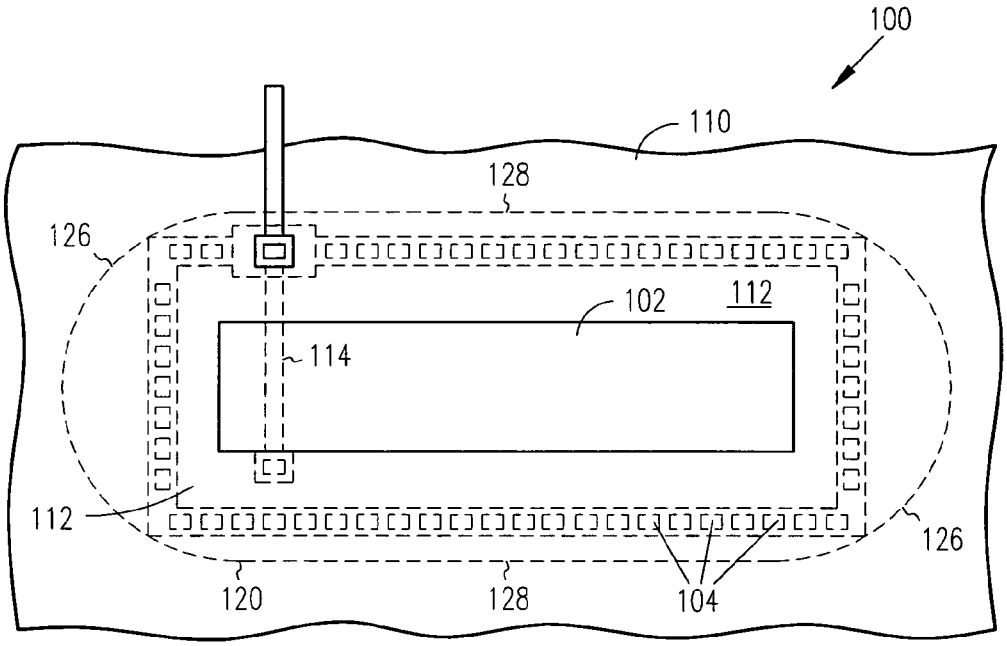
FIGS. 1A through 1D illustrate a cavity-backed slot antenna in accordance with some embodiments of the present invention.
Figure 1B:
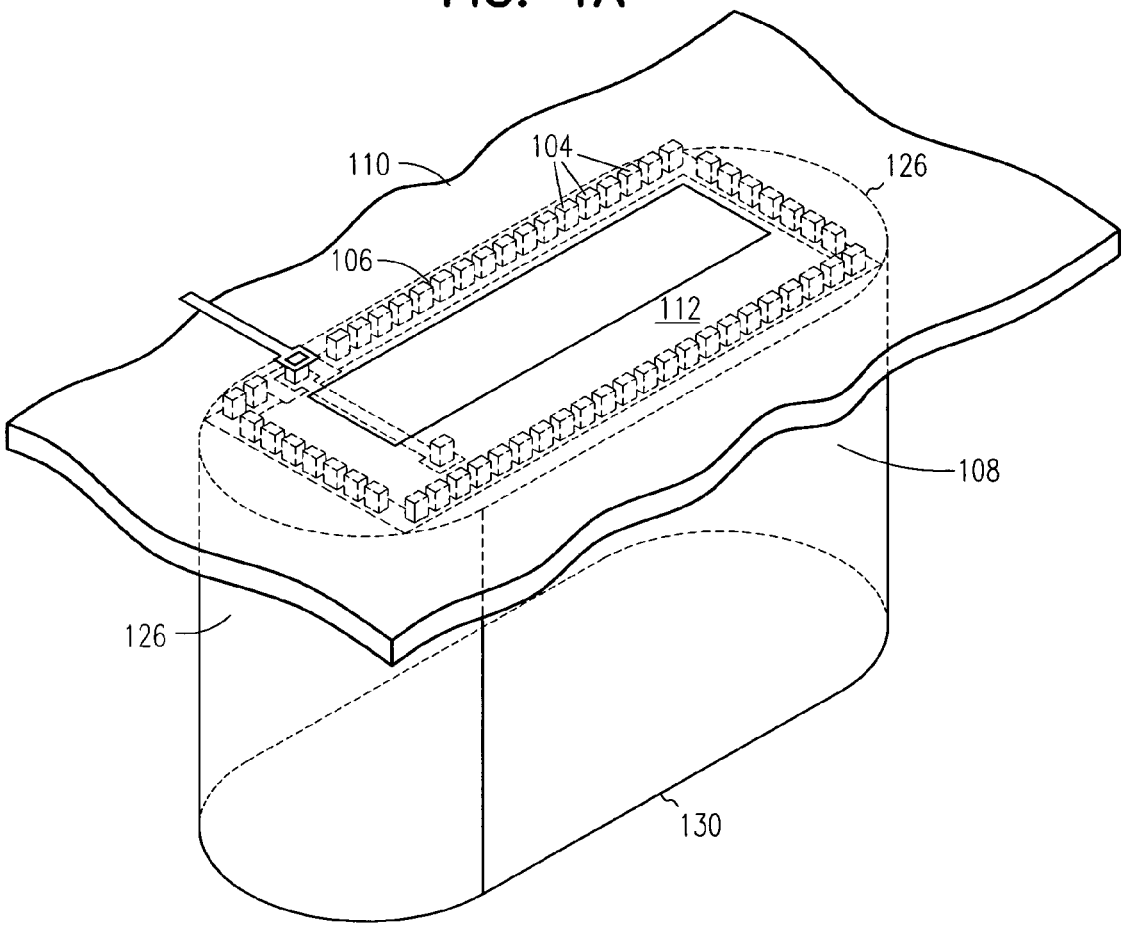
Figure 1C:
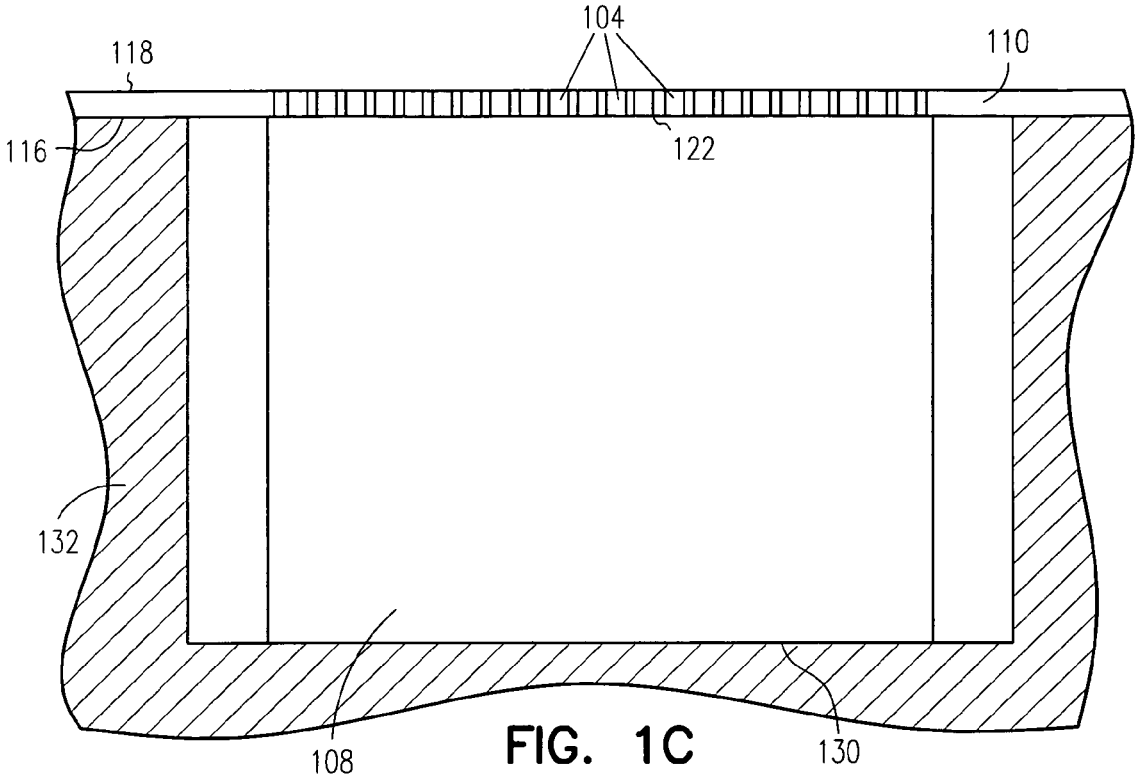
Figure 1D:
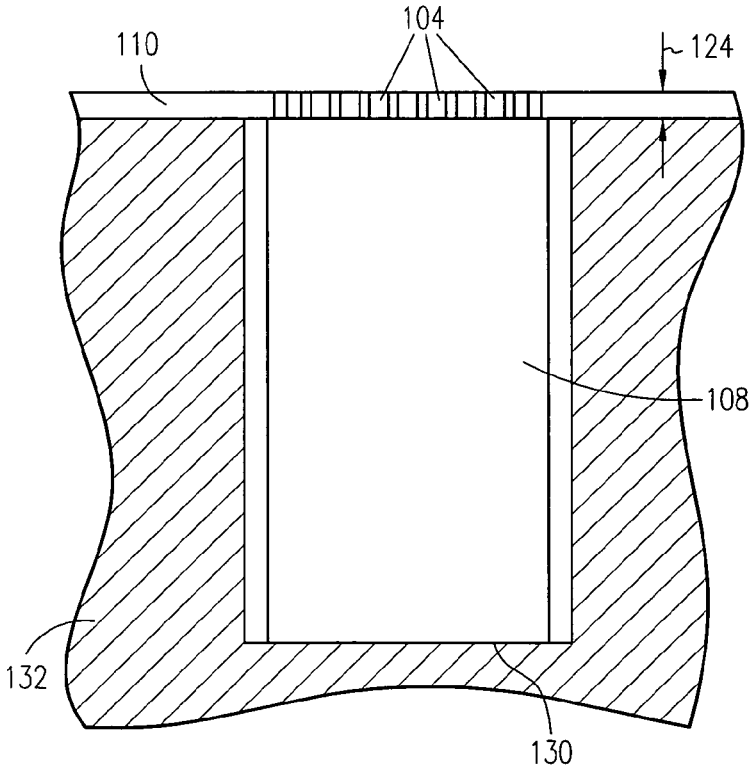

FIGS. 1A through 1D illustrate a cavity-backed slot antenna in accordance with some embodiments of the present invention. FIG. 1A illustrates a top view of cavity-backed slot antenna 100 in accordance with some embodiments of the present invention. FIG. 1B illustrates a perspective view of cavity-backed slot antenna 100 in accordance with some embodiments of the present invention. FIG. 1C illustrates a side view showing the y-dimension of cavity-backed slot antenna 100 in accordance with some embodiments of the present invention. FIG. 1D illustrates a side view showing the x-dimension of cavity-backed slot antenna 100 in accordance with some embodiments of the present invention.

Antenna 100 includes dielectric cavity 102 within semiconductor substrate 110 having walls defined by a plurality of vias 104 through the substrate. Antenna 100 also includes gas cavity 108 external to the substrate 110 aligned with dielectric cavity 102. Conductive feed 114 may be disposed on the substrate across the cavities. In some embodiments, ground plane side 116 of substrate 110 may be devoid of ground plane conductive material 122 substantially between the walls of the dielectric cavity 104. In embodiments in which antenna 100 is a slot antenna 100, feed 114 comprises a microstrip feed line disposed on the substrate across slot 102 over the cavities. Slot 102 may comprise a rectangular region without conductive material on circuit side 118 of substrate 110 substantially centered over dielectric cavity 102. In some embodiments, the microstrip feed line may be disposed on ground plane side 116 of substrate 110 across slot 102. In some embodiments, the position of the microstrip feed line across slot 102 may be selected to match an impedance of the microstrip line to the antenna at one or more frequencies of interest.

In some embodiments, vias 104 may electrically couple ground plane conductor 122 of ground plane side 116 of substrate 110 with conductive material 112 on circuit side 118 of substrate 110. Substrate 110 comprises a dielectric material between ground plane conductor 122 and conductive material 1112. The dielectric may be, for example, Gallium Arsenide, Silicon, Indium Phosphate or other semiconductor material, although the scope of the invention is not limited in this respect. In some embodiments, the substrate may have thickness 124 ranging from one mil or less in thickness to up to three mils or greater in thickness, depending on the dielectric material chosen, and the processes used by the wafer-fabrication facility.

In some embodiments, gas cavity 108 may have air therein, although any gas may be suitable. In some embodiments, gas cavity may be filled with a low-density material other than gas.

Vias 104 may precisely define dielectric cavity 106 as a rectangular dielectric cavity within substrate 110 having rectangular dimensions selected to resonate at a predetermined millimeter-wave frequency. In some embodiments, the millimeter-wave frequency may be a predetermined W-band millimeter-wave frequency, although the scope of the present invention is not limited in this respect. In some embodiments, the length of dielectric cavity 106 may be selected so that dielectric cavity 106 resonates at a frequency of interest. The width of dielectric cavity 106 may be selected based on a desired bandwidth. In some embodiments, the length of antenna 100 may range from thirty mils of less to up to one-hundred mils and greater, depending on the frequency.

In some embodiments, the dimensions of gas cavity 108 may be greater than dimensions of dielectric cavity 106 and selected to be non-resonant at the predetermined millimeter-wave frequency. The width of gas cavity 108 may be selected to permit substantially an evanescent mode to exist within the gas cavity. In some embodiments, the width of gas cavity 108 may be selected to permit only an evanescent mode to exist within the gas cavity, although the scope of the present invention is not limited in this respect.

In some embodiments, vias 104 may be formed with integrated-circuit manufacturing processes, such as photolithography techniques or ion-etch processes, to allow a very accurate positioning of the vias. This accurate and precise dimensioning of dielectric cavity 106 provides very accurate control of the antenna's characteristics including the frequency characteristics. In some embodiments, gas cavity 108, on the other hand, may be fabricated with a less accurate process, such as a machining process described in more detail below.

In some embodiments, substrate 110 may be adhered to conductive plate 132 and gas cavity 108 may be located within conductive plate 132. This is described in more detail below.

In some embodiments, feed 114 may be a microstrip feed line, a coplanar waveguide feed, a parallel line feed, or a slot line feed, although other antenna feed techniques may also be used.

In some other embodiments, antenna 100 may comprise a patch antenna having conductive material to form a patch on circuit side 118 of substrate 110. In these embodiments, a patch may be disposed over dielectric cavity 102 and electrically coupled to the conductive feed.

In some other embodiments, antenna 100 may comprise a spiral antenna having conductive material to form a spiral on circuit side 118 of substrate 110. In these embodiments, a spiral may be disposed over dielectric cavity 102 and electrically coupled to the conductive feed.

In some other embodiments, antenna 100 may comprise a monopole antenna having conductive material to form a monopole on circuit side 118 of substrate 110. In these embodiments, a single pole may be disposed over the dielectric cavity 102 and electrically coupled to the conductive feed.

In some other embodiments, antenna 100 may comprise a stub antenna having conductive material to form an open-ended stub on circuit side 118 of substrate 110. In these embodiments, a stub may be disposed over the dielectric cavity 102 and electrically coupled to the conductive feed.

In some embodiments, gas cavity 108 may be machined in plate 132 to have a first set of substantially semicircular opposite walls 126, a second set of substantially parallel opposite walls 128, and substantially flat bottom 130. In some embodiments, gas cavity 108 may be machined with an end-milling process which may result in the rounded ends or rounded corners. In other embodiments, a photo-machining process, an electric-discharge machining (EDM) process, a water-jet machining process, or other manufacturing processes may be used to fabricate gas cavity 108 in plate 132.

In some embodiments, the presence of gas cavity 108 may change or "move" the resonant frequency of dielectric cavity 106. The size of the dielectric cavity 106 may be appropriately selected to compensate for this movement. The presence of gas cavity 108 may also lower the field amplitude in dielectric cavity 106 to appreciably lower the loss of the antenna. Because gas cavity 108 may be in a cutoff mode at the frequency of interest, the depth of gas cavity 108 may be non-critical. Therefore, machining inaccuracies of the gas-cavity depth may have only a minor effect on the overall resonant frequency of antenna 100. In some embodiments, dielectric cavity 106 may be somewhat smaller than gas cavity 108. This may allow gas cavity 108 to "float" somewhat about dielectric cavity 106 without shorting out the input microstrip feed line. This feature may allow a placement tolerance of the substrate relative to gas cavity 108 to be significantly large.

In some embodiments, an epoxy well may be machined in conductive plate 132. The well may be filled with an adhesive to adhere substrate 110 to plate 132. This is described in more detail below. In some alterative embodiments, substrate 110 may be attached to plate 132 with solder.

Figure 2A:
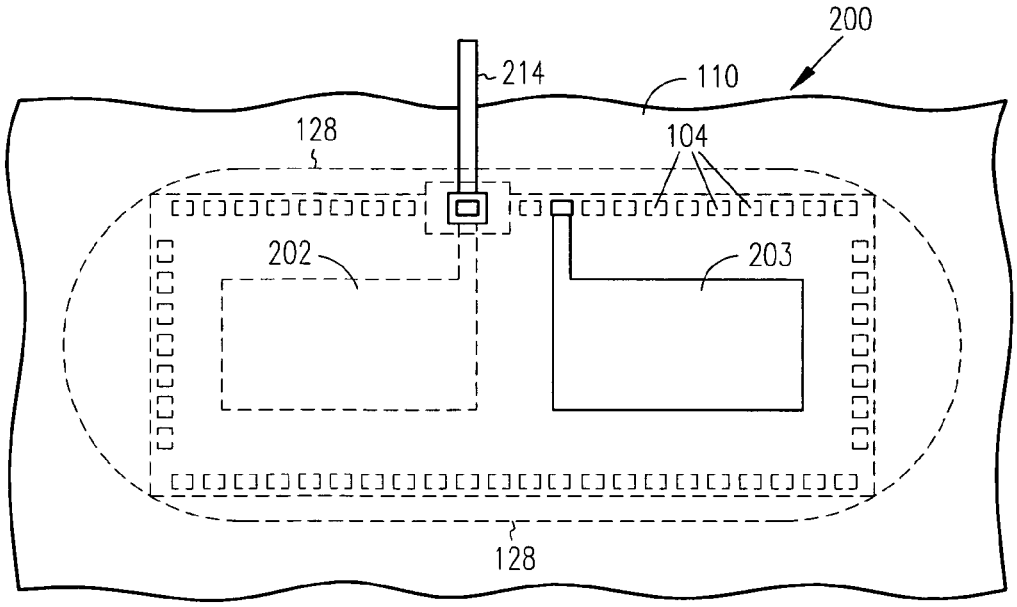
FIGS. 2A and 2B illustrate a cavity-backed dipole antenna in accordance with some embodiments of the present invention.
Figure 2B:
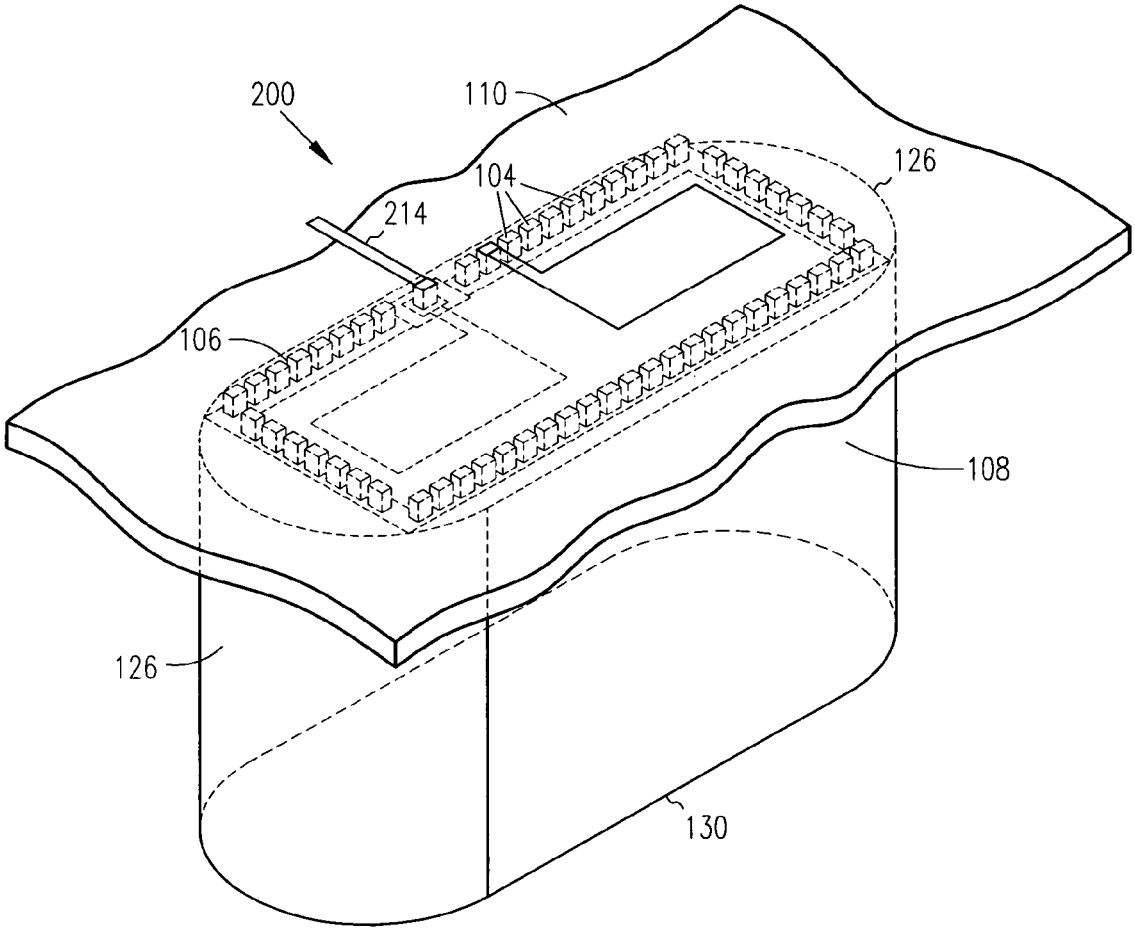

FIGS. 2A and 2B illustrate a cavity-backed dipole antenna in accordance with some embodiments of the present invention. FIG. 2A illustrates a top view of cavity-backed dipole antenna 200 in accordance with some embodiments of the present invention. FIG. 2B illustrates a perspective view of cavity-backed dipole antenna 200 in accordance with some embodiments of the present invention. The side views of cavity-backed dipole antenna 200 correspond with the side views of cavity-backed slot antenna 100 illustrated in FIGS. 1C and 1D.

Antenna 200 is a dipole antenna having first pole 202 and second pole 204. First pole 202 comprises conductive material on ground plane side 116 of substrate 110 disposed over the cavities. Second pole 203 comprises conductive material on circuit side 118 of the substrate 110 disposed over the cavities. In some embodiments, first pole 202 may be disposed over a first portion the cavities and second pole 204 may be disposed over a second portion of the cavities so as not to overlap with the first pole. In these embodiments, the plurality of vias 104 and one of the poles may be electrically coupled to ground, and the other of the poles may be coupled with conductive feed 214.

Although first pole 202 is illustrated on the ground plane side of the substrate and second pole 204 is illustrated on the circuit side of the substrate, the scope of the present invention is not limited in this respect. Either pole may be on the ground plane side of the substrate, or either pole may be on the circuit side of the substrate.

Figure 3:
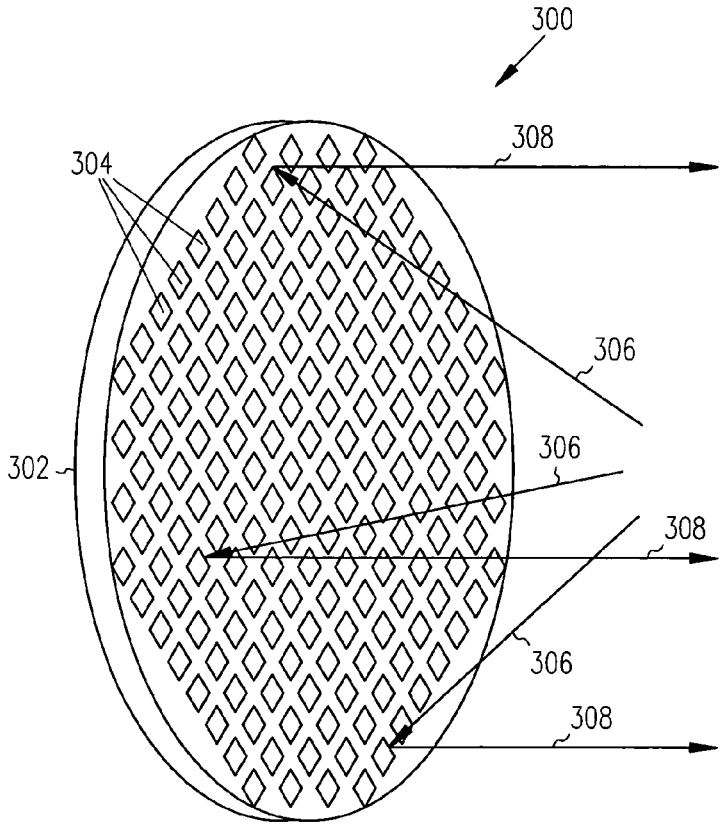
FIG. 3 illustrates a reflect-array antenna in accordance with some embodiments of the present invention.

FIG. 3 illustrates a reflect-array antenna in accordance with some embodiments of the present invention. Reflect-array antenna 300 comprises conductive plate 302, and a plurality of unit cells 304 adhered to conductive plate 302.

Figure 4:
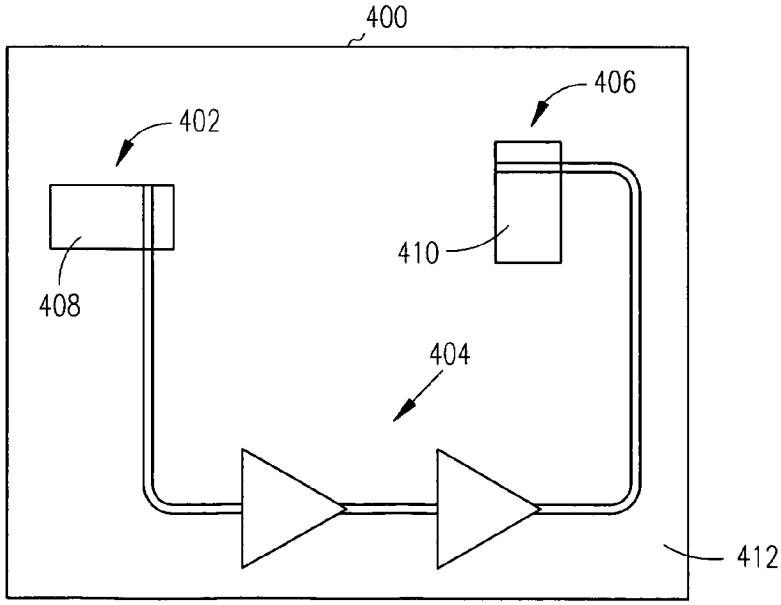
FIG. 4 illustrates a unit cell in accordance with some embodiments of the present invention.

FIG. 4 illustrates a unit cell in accordance with some embodiments of the present invention. Unit cell 400 may be suitable for use as each of unit cells 304 (FIG. 3), although the scope of the invention is not limited in this respect. Each unit cell 400 may comprise receive antenna 402 to receive spatially-fed millimeter-wave signals 306 (FIG. 3) of a first polarization. Each unit cell 400 may also comprise transmit antenna 406 to re-transmit the received signals with a second polarization. Receive antenna 402 and transmit antenna 406 may each comprise a dielectric cavity within a semiconductor substrate having walls defined by a plurality of vias through the substrate, and a gas cavity within conductive plate 302 aligned with the dielectric cavity. Antenna 100 (FIG. 1) and antenna 200 (FIG. 2) are examples of antennas that are suitable for use as either of antennas 402 and 406.

In some embodiments, each unit cell 400 may also include one or more power amplifiers 404 to amplify received signals and provide the amplified signals to transmit antenna 406 for retransmission. In some embodiments, amplifiers 404 may comprise GaAs FET power amplifiers, although the scope of the present invention is not limited in this respect.

In some embodiments, receive antenna 402 and transmit antenna 406 may be slot antennas. In these embodiments, the antennas may have substantially orthogonal (i.e., horizontal and vertical) polarizations. In some embodiments, slot 408 of receive antenna 402 may be orthogonally positioned with respect to slot 410 of transmit antenna 406.

Referring to FIG. 3, in some embodiments, the semiconductor wafers having one or more unit cells thereon may be tiled together on conductive plate 302. In some embodiments, conductive plate 302 may serve as a heat sink for unit cells 304.

In some embodiments, the plurality of unit cells 304 may generate high-power coherent wavefront 308 in response to receipt of spatially-fed millimeter-wave signals 306. In some embodiments, high-power coherent wavefront 308 may be a substantially spherical high-power coherent wavefront, although the scope of the present invention is not limited in this respect.

In some embodiments, one or more of the plurality of unit cells 304 may be fabricated on more than one semiconductor wafer, and the semiconductor wafers tiled together and adhered to plate 302. In some embodiments, the semiconductor wafers may be arranged on a substantially flat surface of plate 302. In some other embodiments, the semiconductor wafers may be arranged on a curved surface of the plate 302. The curved surface may be a substantially parabolic surface, although other curved surfaces are also suitable. In some other embodiments, the plurality of unit cells 304 may be fabricated on a single semiconductor wafer which may be adhered to a substantially flat surface of the plate 302.

Although many embodiments of the present invention are described as using conductive plate 302, this is not a requirement. Other conductive materials may be used to form the gas cavities of the antennas.

Figure 5:
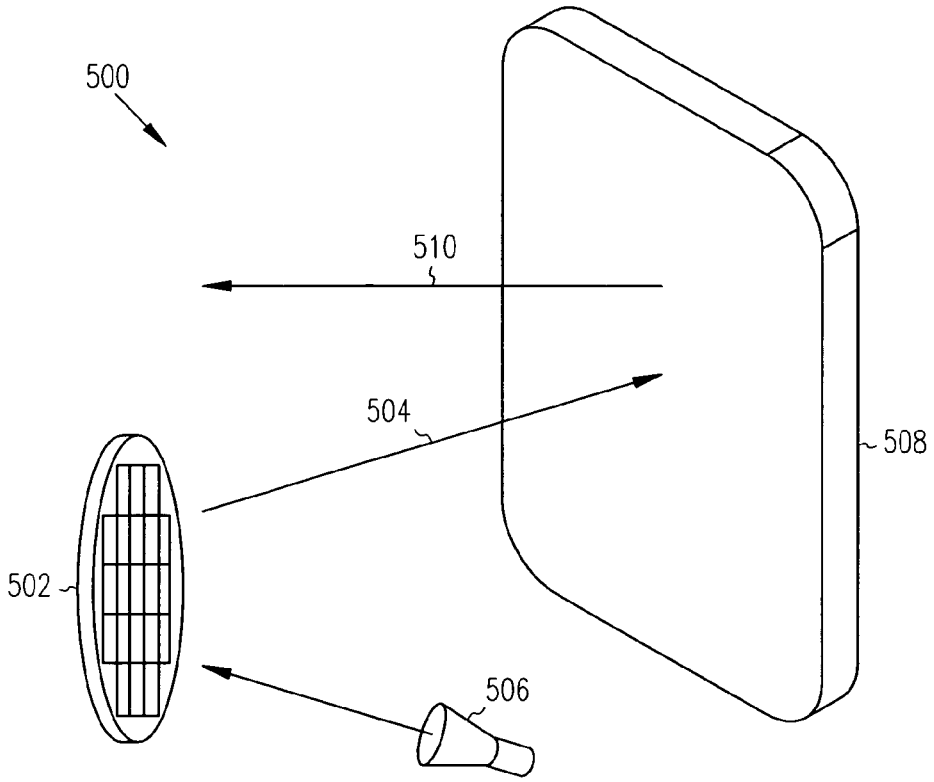
FIG. 5 illustrates a millimeter-wave transmission system in accordance with some embodiments of the present invention.

FIG. 5 illustrates millimeter-wave transmission system in accordance with some embodiments of the present invention. Millimeter-wave transmission system 500 comprises reflect-array antenna 502 to provide high-power substantially coherent wavefront 504 from spatially-fed low power source 506, and collimator 508 to collimate high-power wavefront 504 and generate substantially planar wavefront 510. Reflect array 300 (FIG. 3) may be suitable for use as reflect array antenna 502, although other antennas may also be suitable.

In some embodiments, collimator 508 may comprise a reflective plate. In other embodiments, collimator 508 may comprise a millimeter-wave lens.

In other embodiments, collimator 508 may comprise a plurality of individual antenna elements arranged circumferentially around a center point. Each antenna element may receive and transmit signals to provide approximately a 180-degree phase shift. The antenna elements may be sized and shaped to receive high-power substantially spherical wavefront 504 and to generate planar wavefront 510. In some embodiments, the plurality of individual antenna elements may be dual-polarized dipoles of differing sizes and shapes.

Figure 6:
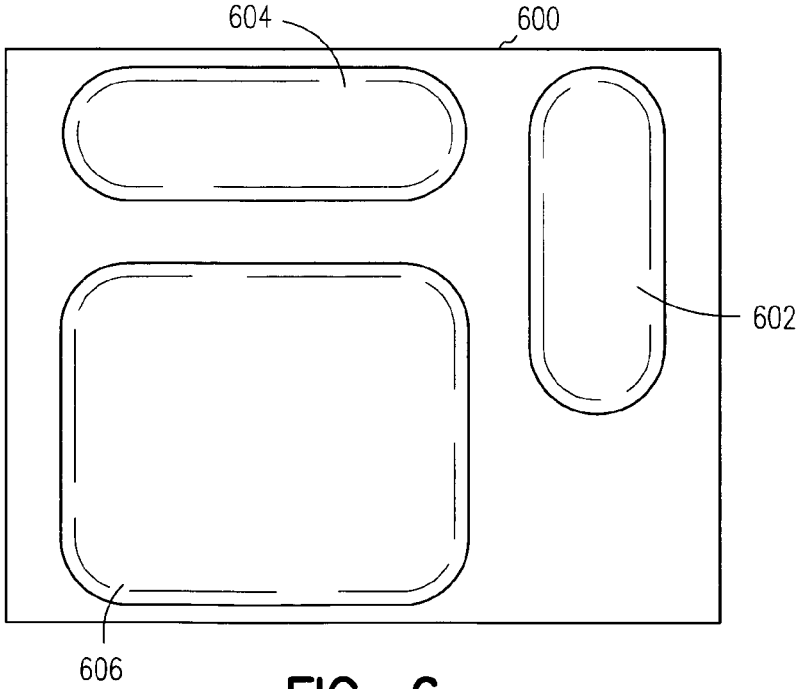
FIG. 6 is a top view of a portion of a conductive plate in accordance with some embodiments of the present invention.

FIG. 6 is a top view of a portion of a conductive plate suitable for use in accordance with some embodiments of the present invention. Portion of conductive plate 600 may be suitable for use as a portion of conductive plate 132 (FIG. 1) and conductive plate 302 (FIG. 3). The portion illustrated in FIG. 6 may be suitable for use with a single unit cell, such as unit cell 304 (FIGS. 3 and 4). Conductive plate 600 includes first cavity 602, second cavity 604 and epoxy well 606. Either of first and second cavities 602, 604 may correspond with gas cavity 108 (FIG. 1) and may be suitable for use the gas cavities of the receive and transmit cavity-backed antennas of unit cell 304 (FIGS. 3 and 4). In some embodiments, epoxy well 606 may be filled with an epoxy or adhesive to adhere substrate 110 (FIG. 1) to plate 600. First and second cavities 602 and 604 are illustrated within plate 600 as being orthogonal with respect to each other for embodiments which use orthogonally polarized receive and transmit antennas.

Figure 7:
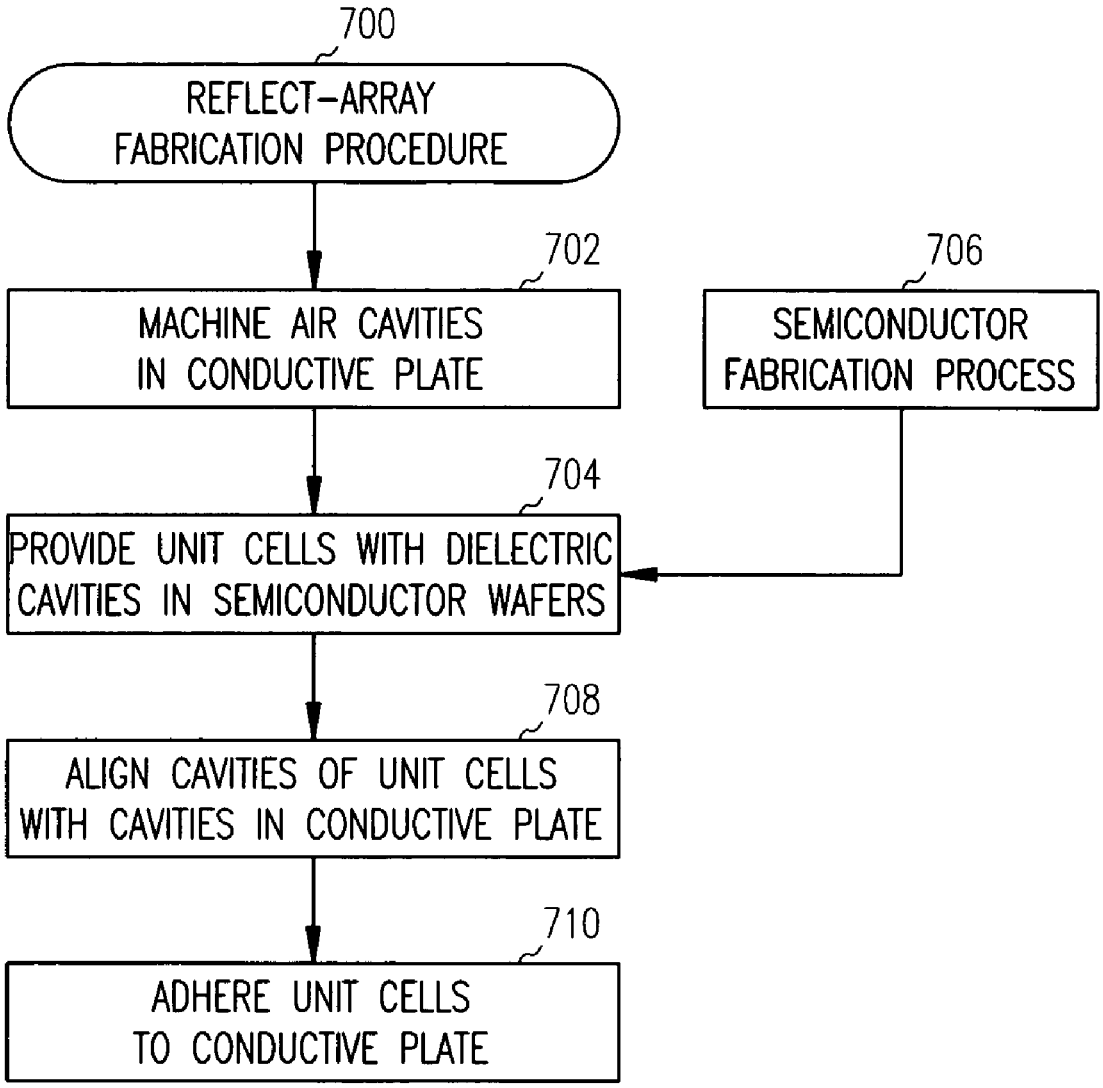
FIG. 7 is a flow chart of a reflect-array fabrication procedure in accordance with some embodiments of the present invention.

FIG. 7 is a flow chart of a reflect-array fabrication procedure in accordance with some other embodiments of the present invention. Procedure 700 may be used to fabricate a reflect-array antenna, such as reflect-array antenna 304 (FIG. 3) although other procedures may also be suitable. Operation 702 comprises machining air cavities, such as air cavities 108 (FIG. 1) in a conductive plate, such as conductive plate 302 (FIG. 3).

Operation 704 comprises providing unit cells, such as unit cells 304 (FIG. 3). Each unit cell may have receive antenna, such as receive antenna 402 (FIG. 4), and a transmit antenna, such as transmit antenna 406 (FIG. 4). The antennas may have dielectric cavities, such as dielectric cavities 106 (FIG. 1), within a semiconductor substrate, such as semiconductor substrate 110. In some embodiments, the unit cells may be fabricated by a semiconductor manufacturing process 706.

Operation 708 comprises aligning the dielectric cavities of the unit cells with the air cavities in the conductive plate to provide the two cavities for each of the antennas. Operation 710 comprises adhering the semiconductor substrates to the conductive plate in the aligned position.

In some embodiments, operation 702 comprises machining a gas cavity to have a first set of substantially semicircular opposite walls 126 (FIG. 1), a second set of substantially parallel opposite walls 128 (FIG. 1), and a substantially flat bottom 130 (FIG. 1). In some embodiments, operation 702 comprises machining an epoxy well, such as well 606 (FIG. 6), in the plate, and operation 710 comprises filling the well with an adhesive to adhere the substrate to the plate. The epoxy well may be localized in an area away from the cavities.

In some other embodiments, operation 710 comprises adhering the substrate to the plate with indium solder or other low temperature solder. In these embodiments, the air cavity may be constructed from a copper-molly alloy or other alloy that has a similar coefficient of thermal expansion as the integrated circuit substrate. The plate may be plated with the indium solder. This substrate may be held down unto the plate and heated up to the melting temperature of the solder. In one embodiment, the substrate may be held down onto the conductive plate via vacuum through cavities 602 and/or 606 (FIG. 6). In this embodiment, cavities 602 and/or 606 (FIG. 6) may be fully or partially open at one end.

It is emphasized that the Abstract is provided to comply with 37 C.F.R. Section 1.72(b) requiring an abstract that will allow the reader to ascertain the nature and gist of the technical disclosure. It is submitted with the understanding that it will not be used to limit or interpret the scope or meaning of the claims.

In the foregoing detailed description, various features are occasionally grouped together in a single embodiment for the purpose of streamlining the disclosure. This method of disclosure is not to be interpreted as reflecting an intention that the claimed embodiments of the subject matter require more features that are expressly recited in each claim. Rather, as the following claims reflect, inventive subject matter lies in less than all features of a single disclosed embodiment. Thus the following claims are hereby incorporated into the detailed description, with each claim standing on its own as a separate preferred embodiment.

What is claimed is:

1. An antenna comprising:

a dielectric cavity within a semiconductor substrate having walls defined by a plurality of vias through the substrate;

a gas cavity external to the substrate aligned with the dielectric cavity; and a conductive feed disposed on the substrate across the cavities.

2. The antenna of claim 1 wherein a ground plane side of the substrate is devoid of ground plane conductive material substantially between the walls of the dielectric cavity.

3. The antenna of claim 2 wherein the antenna is a slot antenna, and wherein the feed comprises a microstrip feed line disposed on the substrate across a slot over the cavities, and wherein the slot comprises a rectangular region without conductive material on a circuit side of the substrate over the dielectric cavity.

4. The antenna of claim 3 wherein the microstrip feed line is disposed on the ground plane side of the substrate across the slot.

5. The antenna of claim 1 wherein the antenna is a dipole antenna further comprising:

a first pole comprising conductive material on a ground plane side of the substrate disposed over the cavities; and a second pole comprising conductive material on a circuit side of the substrate disposed over the cavities, wherein the plurality of vias and one of the poles are electrically coupled to a ground, and wherein the other of the poles is coupled with the conductive feed.

6. The antenna of claim 2 wherein the vias electrically couple a ground plane conductor of a ground plane side of the substrate with conductive material on a circuit side of the substrate.

7. The antenna of claim 6 wherein the substrate comprises a dielectric material between the ground plane conductor and the conductive material, the dielectric being one of Gallium Arsenide, Silicon, and Indium Phosphate.

8. The antenna of claim 2 wherein the gas cavity has air therein.

9. The antenna of claim 2 wherein the plurality of vias define the dielectric cavity as a rectangular dielectric cavity within the substrate having rectangular dimensions selected to resonate at a millimeter-wave frequency.

10. The antenna of claim 9 wherein the dimensions of the gas cavity are greater than dimensions of the dielectric cavity and selected to be non-resonant at the millimeter-wave frequency, and wherein a width of the gas cavity is selected to permit substantially an evanescent mode to exist within the gas cavity.

11. The antenna of claim 2 wherein the substrate is adhered to a conductive plate, and wherein the gas cavity is located within the conductive plate.

12. The antenna of claim 1 wherein the feed is one of a microstrip feed line, a coplanar waveguide feed, a parallel line feed, a slot line feed.

13. The antenna of claim 2 wherein the antenna comprises a patch antenna comprising conductive material to form a patch on a circuit side of the substrate, the patch being disposed over the dielectric cavity and electrically coupled to the conductive feed.

14. The antenna of claim 2 wherein the antenna comprises a spiral antenna comprising conductive material to form a spiral on a circuit side of the substrate, the spiral being disposed over the dielectric cavity and electrically coupled to the conductive feed.

15. The antenna of claim 2 wherein the antenna comprises a monopole antenna comprising conductive material to form a monopole on a circuit side of the substrate, the monopole being disposed over the dielectric cavity and electrically coupled to the conductive feed.

16. The antenna of claim 2 wherein the antenna comprises a stub antenna comprising conductive material to form an open-ended stub on a circuit side of the substrate, the stub being disposed over the dielectric cavity and electrically coupled to the conductive feed.

17. The antenna of claim 10 wherein the gas cavity is machined to have a first set of substantially semicircular opposite walls, a second set of substantially parallel opposite walls, and a substantially flat bottom.

18. A reflect-array antenna comprising:

a conductive plate; and a plurality of unit cells adhered to the conductive plate, wherein each unit cell comprises:

a receive antenna to receive spatially-fed millimeter-wave signals of a first polarization; and a transmit antenna to re-transmit the received signals with a second polarization, wherein the receive antenna and the transmit antenna each comprises:

a dielectric cavity within a semiconductor substrate having walls defined by a plurality of vias through the substrate; and a gas cavity within the conductive plate aligned with the dielectric cavity.

19. The reflect-array antenna of claim 18 wherein each unit cell further comprises one or more power amplifiers to amplify the received signals and provide the amplified signals to the transmit antenna for retransmission.

20. The reflect-array antenna of claim 19 wherein the conductive plate is to serve as a heat sink for the unit cells.

21. The reflect-array antenna of claim 20 wherein the receive and transmit antennas are slot antennas, wherein the first and second polarizations are orthogonal, and wherein a slot of the receive antenna is orthogonally positioned with respect to a slot of the transmit antenna.

22. The reflect-array antenna of claim 21 wherein the plurality of unit cells is to generate a high-power coherent wavefront.

23. The reflect-array antenna of claim 21 wherein one or more of the plurality of unit cells are fabricated on more than one semiconductor wafer, the semiconductor wafers tiled together and adhered to the plate.

24. The reflect-array antenna of claim 23 wherein the semiconductor wafers are arranged on a substantially flat surface of the plate.

25. The reflect-array antenna of claim 23 wherein the semiconductor wafers are arranged on a curved surface of the plate.

26. The reflect-array antenna of claim 21 wherein the plurality of unit cells is fabricated on a semiconductor wafer which is adhered to a substantially flat surface of the plate.

27. The reflect-array antenna of claim 18 wherein a ground plane side of the substrate is devoid of ground plane conductive material substantially between the walls of the dielectric cavity, wherein the antenna comprises a slot-antenna further comprising a microstrip feed line disposed on the substrate across a slot over the cavities, and wherein the slot comprises a rectangular region without conductive material on a circuit side of the substrate over the dielectric cavity.

28. The reflect-array antenna of claim 27 wherein the vias electrically couple a ground plane conductor of a ground plane side of the substrate with conductive material on a circuit side of the substrate, and wherein the substrate comprises a dielectric material between the ground plane conductor and the conductive material, the dielectric being one of Gallium Arsenide, Silicon, and Indium Phosphate.

29. The reflect-array antenna of claim 27 wherein the plurality of vias define the dielectric cavity as a rectangular dielectric cavity within the substrate having rectangular dimensions selected to resonate at a millimeter-wave frequency, wherein the dimensions of the gas cavity are greater than dimensions of the dielectric cavity and selected to be non-resonant at the millimeter-wave frequency, and wherein a width of the gas cavity is selected to permit substantially an evanescent mode to exist therein.

30. The reflect-array antenna of claim 18 wherein the gas cavity is machined to have a first set of substantially semicircular opposite walls, a second set of substantially parallel opposite walls, and a substantially flat bottom.

31. A millimeter-wave transmission system comprising:

a reflect-array antenna to provide a high-power substantially coherent wavefront from a spatially-fed low power source; and a collimator to collimate the high-power wavefront and generate a substantially planar wavefront, wherein the reflect-array antenna comprises:

a plurality of unit cells adhered onto the conductive plate, wherein each unit cell comprises:

a receive antenna to receive spatially-fed millimeter-wave signals of a first polarization; and a transmit antenna to re-transmit the received signals with a second polarization, wherein the receive antenna and the transmit antenna each comprises:

a dielectric cavity within a semiconductor substrate having walls defined by a plurality of vias through the substrate; and a gas cavity within a conductive plate aligned with the dielectric cavity.

32. The system of claim 31 wherein each unit cell further comprises one or more power amplifiers to amplify the received signals and provide the amplified signals to the transmit antenna for retransmission.

33. The system of claim 31 wherein the receive and transmit antennas are slot antennas, wherein the first and second polarizations are orthogonal, and wherein a slot of the receive antenna is orthogonally positioned with respect to a slot of the transmit antenna.

34. The system of claim 33 wherein a ground plane side of the substrate is devoid of ground plane conductive material substantially between the walls of the dielectric cavity, wherein the antennas further comprise a microstrip feed line disposed on the substrate across each slot over the cavities, and wherein the slots comprise a rectangular region substantially without conductive material on a circuit side of the substrate over the dielectric cavities.

35. The system of claim 31 wherein the collimator comprises a reflective plate.

36. The system of claim 31 wherein the collimator comprises a millimeter-wave lens.

37. The system of claim 31 wherein the collimator comprises a plurality of individual antenna elements arranged circumferentially around a center point, each antenna element to receive and transmit signals to provide approximately a 180-degree phase shift, the antenna elements being sized and shaped to receive a high-power substantially spherical wavefront and generate the planar wavefront.

38. A method of fabricating a reflect-array antenna comprising:

machining air cavities in a conductive plate;

providing unit cells each having a receive antenna and a transmit antenna thereon, the antennas having dielectric cavities within a semiconductor substrate; and adhering the unit cells to the conductive plate to substantially align with the air cavities with the dielectric cavities.

39. The method of claim 38 wherein providing comprises providing unit cells wherein the dielectric cavities have walls defined by a plurality of vias through the substrate, and wherein a ground plane side of the substrate is devoid of ground plane conductive material substantially between the walls of the dielectric cavity.

40. The method of claim 39 wherein machining comprises machining the gas cavity to have a first set of substantially semicircular opposite walls, a second set of substantially parallel opposite walls, and a substantially flat bottom.

41. The method of claim 38 wherein machining comprises machining an epoxy well in the plate, and wherein adhering comprises filling the well with an adhesive to adhere an amplifier portion of the substrate to the plate.

42. The method of claim 38 wherein adhering comprising adhering the substrate to the plate with indium solder.

* * * * *